US011022135B2

(12) United States Patent
Oda et al.

(10) Patent No.: US 11,022,135 B2
(45) Date of Patent: Jun. 1, 2021

(54) IMPELLER AND ROTATING MACHINE

(71) Applicant: MITSUBISHI HEAVY INDUSTRIES COMPRESSOR CORPORATION, Tokyo (JP)

(72) Inventors: Takashi Oda, Hiroshima (JP); Nobuyori Yagi, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/796,199

(22) Filed: Feb. 20, 2020

(65) Prior Publication Data

US 2020/0271124 A1 Aug. 27, 2020

(30) Foreign Application Priority Data

Feb. 26, 2019 (JP) ..... JP2019-032344

(51) Int. Cl.
*F04D 29/44* (2006.01)
*F04D 29/28* (2006.01)
*F04D 29/30* (2006.01)

(52) U.S. Cl.
CPC ..... *F04D 29/284* (2013.01); *F04D 29/444* (2013.01); *F04D 29/30* (2013.01)

(58) Field of Classification Search
None
See application file for complete search history.

(56) References Cited

U.S. PATENT DOCUMENTS 5,149,253 A * 9/1992 Miyamoto ..... F04D 13/0646 310/156.21
2011/0008160 A1* 1/2011 Ressing ..... F04D 29/2216 415/203
2013/0251531 A1 9/2013 Yagi et al.
2014/0050585 A1* 2/2014 Kawanishi ..... F04D 29/28 416/177
2015/0159670 A1 6/2015 Saito
2016/0319833 A1 11/2016 Rubino et al.
2016/0327050 A1 11/2016 Nakaniwa et al.
2017/0306761 A1* 10/2017 Okabe ..... F04D 17/10
2018/0328376 A1* 11/2018 Ishii ..... F04D 25/064
(Continued)

FOREIGN PATENT DOCUMENTS

CN 101970883 A 2/2011
CN 102203428 A 9/2011
CN 103237993 A 8/2013
(Continued)

*Primary Examiner* — Michael Lebentritt
(74) *Attorney, Agent, or Firm* — Osha Bergman Watanabe & Burton LLP

(57) ABSTRACT

An impeller 40 includes a disk 41 having a disk shape centered on an axis O, a plurality of blades 42 provided on a disk main surface 413 of the disk 41 facing a first side Dau in an axial direction Da at intervals in a circumferential direction around the axis O, and a cover 43 that covers the plurality of blades 42 from the first side Dau and gradually expands in diameter from the first side Dau toward a second side Dad in the axial direction. The cover 43 has a thick portion 49 at a position distant from a first end portion 431 positioned closest to the first side, the thick portion having a thickness greater than the thickness of the first end portion 431.

12 Claims, 2 Drawing Sheets

(56) References Cited

U.S. PATENT DOCUMENTS

| | | | | |
|---|---|---|---|---|
| 2019/0242396 | A1* | 8/2019 | Ishii | F04D 29/30 |
| 2019/0249673 | A1* | 8/2019 | Otsuki | F04D 13/06 |

FOREIGN PATENT DOCUMENTS

| | | | |
|---|---|---|---|
| CN | 104487711 | A | 4/2015 |
| CN | 105899814 | A | 8/2016 |
| CN | 106164496 | A | 11/2016 |
| DE | 102016200519 | A1 | 7/2017 |
| EP | 0694697 | A1 | 1/1996 |
| EP | 2395246 | A1 | 12/2011 |
| JP | 2011-085088 | A | 4/2011 |
| JP | 2015-048708 | A | 3/2015 |
| WO | 2015/104282 | A1 | 7/2015 |

* cited by examiner

IMPELLER AND ROTATING MACHINE

BACKGROUND OF THE INVENTION

Field of the Invention

The present invention relates to an impeller and a rotating machine.

Priority is claimed on Japanese Patent Application No. 2019-032344, filed on Feb. 26, 2019, the content of which is incorporated herein by reference.

Description of Related Art

As a rotating machine used for a compressor, a turbo refrigerator, a small gas turbine, and the like, a structure including an impeller in which a plurality of blades are attached to a disk fixed to a rotating shaft is known. The rotating machine gives pressure energy and velocity energy to a fluid flowing inside by rotating the impeller.

In such a rotating machine, for example, Japanese Unexamined Patent Application, First Publication No. 2011-85088 discloses a structure including a concave portion that is recessed toward an inlet side of an impeller into which a gas is introduced, on a back surface of a disk. According to such a configuration, it is possible to reduce the weight of the impeller while maintaining a required strength.

SUMMARY OF THE INVENTION

If an attempt is made to further reduce the weight of the structure of Japanese Unexamined Patent Application, First Publication No. 2011-85088, there is a concern that the strength of the impeller may be insufficient. Therefore, it is desired to further reduce the weight of the impeller while maintaining a required strength.

The present invention provides an impeller and a rotating machine capable of further reducing weight while maintaining a required strength.

An impeller according to an aspect of the present invention includes: a disk having a disk shape centered on an axis; a plurality of blades provided on a front surface of the disk facing a first side in an axial direction at intervals in a circumferential direction around the axis; and a cover that covers the plurality of blades from the first side and gradually expands in diameter from the first side toward a second side in the axial direction, wherein the cover has a thick portion at a position distant from a first end portion positioned closest to the first side, the thick portion having a thickness greater than the thickness of the first end portion.

With such a configuration, in the cover, only the thickness of the thick portion is larger than the thickness of the first end portion. As a result, a weight of the cover is reduced. In addition, in the cover, a centrifugal force when the impeller rotates around the axis acts more as being further distant from the first end portion in the axial direction. Further, a pressure of the working fluid flowing between the disk and the cover increases from the inner side toward the outer side in the radial direction. That is, a more pressure by the working fluid acts as being further distant from the first end portion in the axial direction. On the other hand, in the cover, by making a position distant from the first end portion the thickest thick portion, a sufficient strength of the impeller is secured against the centrifugal force and the pressure of the working fluid. Accordingly, it is possible to further reduce weight while maintaining the required strength of the impeller.

In addition, according to a second aspect of the present invention, in the impeller of the first aspect, the thickness of the thick portion may increase from the first side toward the second side.

With such a configuration, when the impeller rotates, the thickness of the thick portion can be partially increased in response to an influence of the working fluid of which a pressure gradually increases toward an outlet of the impeller. Therefore, the necessary strength of the impeller can be appropriately maintained without increasing the weight excessively.

In addition, according to a third aspect of the present invention, in the impeller of the first or second aspect, the cover may have a transition portion that connects the first end portion and the thick portion with each other and increases in thickness from the first side toward the second side.

With such a configuration, the thickness of the cover can be partially increased over a wide region in the axial direction in response to an influence of the working fluid flowing between the disk and the cover. As a result, a shape of the cover can be made an appropriate shape according to the pressure of the working fluid. In addition, since the thickness gradually increases, a locally high stress is hardly generated in the cover. Therefore, the necessary strength of the impeller can be more appropriately maintained.

In addition, according to a fourth aspect of the present invention, in the impeller of the any one of the first to third aspects, in the disk, a concave portion may be formed on a back surface facing the second side in the axial direction, the concave portion being recessed toward the first side in the axial direction, and in the axial direction, the thick portion may be formed in a region overlapping with a position of a bottom of the concave portion in the axial direction.

In the portion where the concave portion is formed, a rigidity of the disk decreases, and a stress tends to concentrate on a connection portion between the disk and the blade. On the other hand, the thick portion is formed in the axial direction so as to correspond to the position where the bottom portion of the concave portion is formed. As a result, the disk can be reinforced by the cover via the blade. Accordingly, the stress generated at the connection portion between the disk and the blade can be reduced.

In addition, a rotating machine according to a fifth aspect of the present invention includes: a rotating shaft that is configured to rotate around an axis; and the impeller according to any one of the first to fourth aspects fixed to the rotating shaft.

With such a configuration, it is possible to provide a rotating machine having an impeller capable of further reducing a weight while maintaining a required strength.

According to the present invention, it is possible to further reduce weight while maintaining the required strength.

DETAILED DESCRIPTION OF THE INVENTION

Hereinafter, an embodiment for implementing an impeller and a rotating machine according to the present invention will be described with reference to the accompanying drawings. However, the present invention is not limited only to the embodiment.

Figure 1:
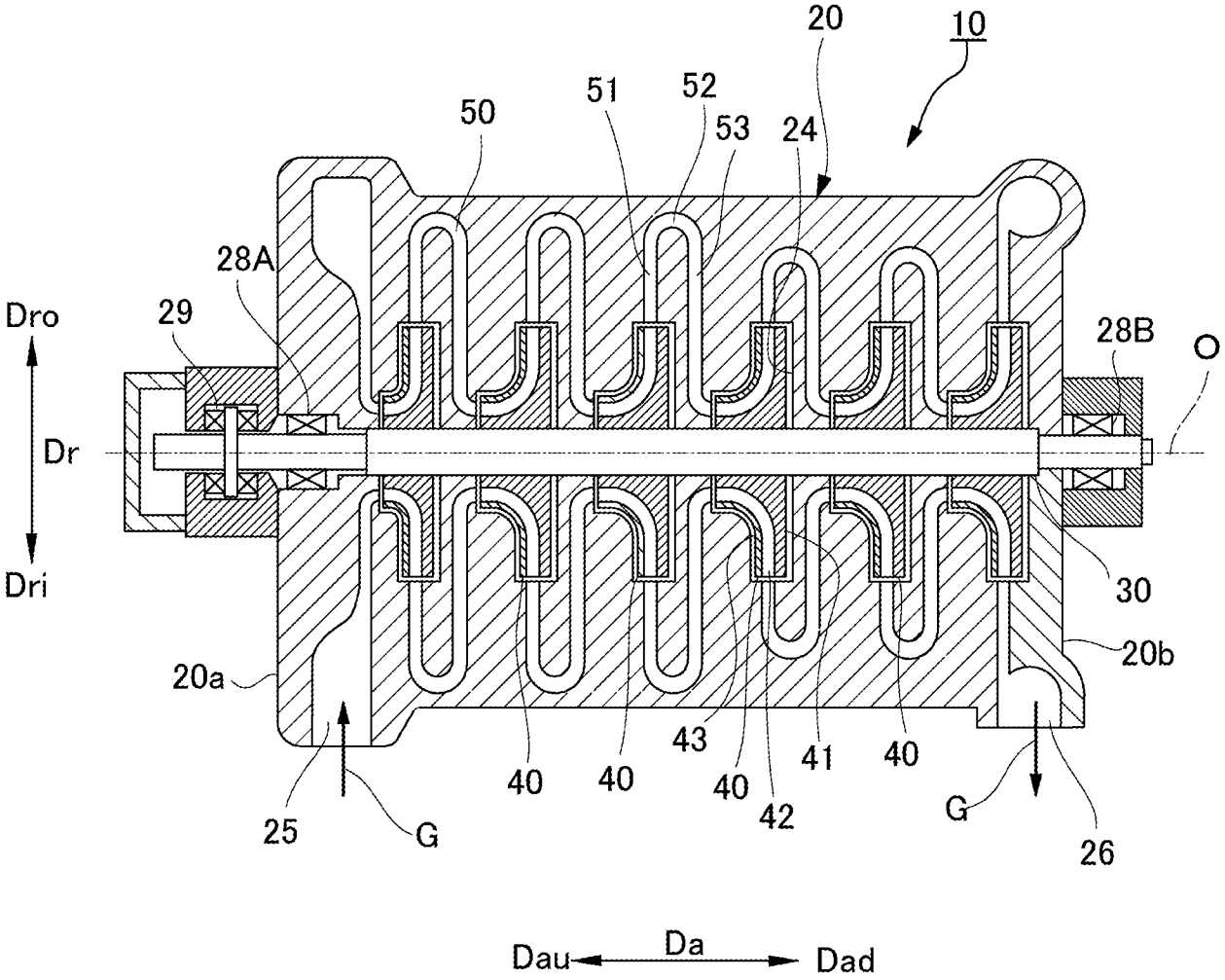
FIG. 1 is a longitudinal sectional view of a rotating machine according to an embodiment of the present invention.

FIG. 1 is a longitudinal sectional view of a rotating machine according to an embodiment of the present invention. As shown in FIG. 1, a centrifugal compressor (rotating machine) 10 according to the present embodiment mainly includes a casing 20, a rotating shaft 30, and an impeller 40.

The casing 20 accommodates the rotating shaft 30 and the impeller 40. The casing 20 has a cylindrical shape extending in a direction in which an axis O of the rotating shaft 30 extends (hereinafter, this direction is referred to as an axial direction Da). The casing 20 is provided with an internal space 24 in which a diameter is repeatedly reduced and increased. The impeller 40 is accommodated in the internal space 24.

A suction port 25 through which a working fluid (process gas) G flows into the casing 20 from an outside is provided at first end portion 20*a* of the casing 20 on a first side (upstream side) Dau in the axial direction Da. In addition, a discharge port 26 through which the working fluid G flows out to the outside of the casing 20 is provided at the second end portion 20*b* of the casing 20 on a second side (downstream side) Dad in the axial direction Da.

A casing-side flow path 50 is formed in the casing 20 so as to connect the impellers 40 to each other. The casing-side flow path 50 allows the working fluid G flowing through the impeller 40 to flow from the first side Dau to the second side Dad in the axial direction Da in the casing 20.

The casing-side flow path 50 has a diffuser portion 51, a return bend portion 52, and a return flow path 53. The diffuser portion 51 extends from an outer peripheral portion of the impeller 40 in a radial direction Dr toward an outer side Dro in the radial direction Dr. The return bend portion 52 is turned in a U-shape in cross section from an outer peripheral portion of the diffuser portion 51 in the radial direction Dr, and extends toward an inner side Dri in the radial direction Dr. The return bend portion 52 guides the working fluid G, which flows toward the outer side Dro in the radial direction Dr, by reversing a flow direction of the working fluid G toward the inner side Dri in the radial direction Dr. The return flow path 53 extends from the return bend portion 52 toward the inner side Dri in the radial direction Dr to an end portion of the impeller 40 on the first side Dau in the axial direction Da.

The rotating shaft 30 is rotatably supported around the axis O with respect to the casing 20 via journal bearings 28A and 28B. The journal bearing 28A is fixed to a first end portion 20*a* of the casing 20. The journal bearing 28B is fixed to a second end portion 20*b* of the casing 20. In addition, a thrust bearing 29 is further fixed to the first end portion 20*a* of the casing 20. One end portion of the rotating shaft 30 in the axial direction Da is supported by the thrust bearing 29 in the axial direction Da.

A plurality of the impellers 40 are fixed to the rotating shaft 30, respectively. The impeller 40 compresses the working fluid G using a centrifugal force. The plurality of impellers 40 are accommodated in the internal space 24 inside the casing 20 at intervals in the axial direction Da. Further, although FIG. 1 shows an example in which six impellers 40 are provided, at least one or more impellers 40 may be provided.

Figure 2:
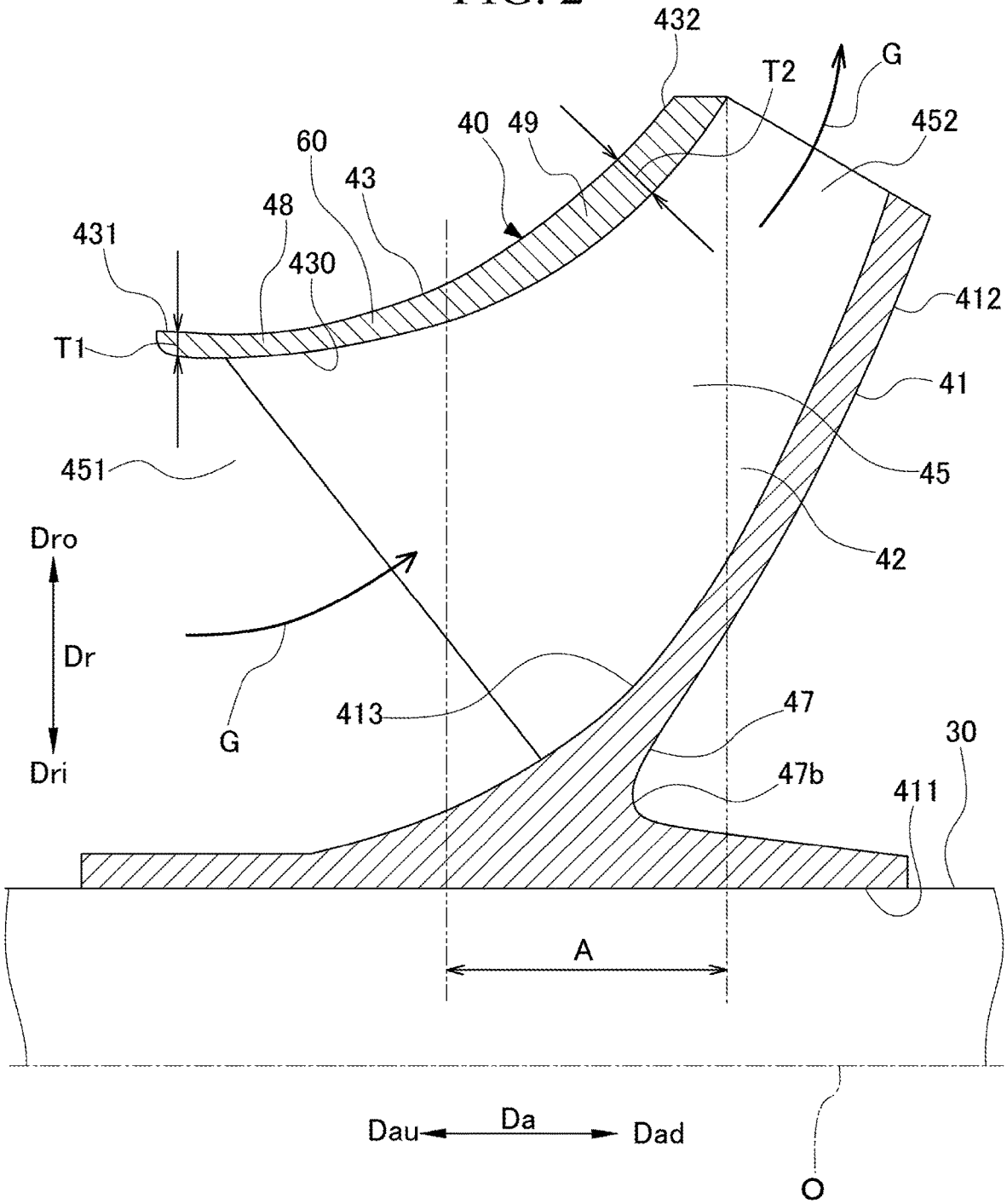
FIG. 2 is a sectional view showing an upper half of an impeller provided in the rotating machine.

FIG. 2 is a sectional view showing an upper half of an impeller provided in the rotating machine. As shown in FIG. 2, each impeller 40 is a so-called closed impeller including a disk 41, a blade 42, and a cover 43.

The disk 41 is formed in a disk shape centered on the axis O. The disk 41 is formed so as to gradually expand in diameter toward the outer side Dro in the radial direction Dr, from the first side Dau toward the second side Dad in the axial direction Da.

A circular through-hole 411 penetrating in the axial direction Da is formed in a center of the disk 41. The impeller 40 is integrally fixed to the rotating shaft 30 with an inner peripheral surface of the through-hole 411 fitted into an outer peripheral surface of the rotating shaft 30.

A surface of the disk 41 facing the second side Dad in the axial direction Da is a back surface 412 that expands in a direction intersecting with the axis O. A concave portion 47 is formed on the back surface 412. The concave portion 47 is formed so as to be recessed from the back surface 412 toward the first side Dau in the axial direction Da. When viewed from the radial direction Dr, the concave portion 47 is recessed toward the first side Dau in the axial direction Da from a second end portion 432 of the cover 43 on the second side Dad in the axial direction Da. That is, a position of a bottom 47*b* of the concave portion 47 in the axial direction Da is positioned on the first side Dau in the axial direction Da with respect to the second end portion 432 of the cover 43. Here, the bottom 47*b* of the concave portion 47 is formed on a most first side Dau in the axial direction Da in the concave portion 47. The concave portion 47 is formed near a middle in the radial direction Dr, in the back surface 412. The concave portion 47 is formed at a position distant from the through-hole 411 toward the outer side Dro in the radial direction Dr. The concave portion 47 is formed at a position distant from an end portion of the back surface 412 on the outer side Dro in the radial direction Dr, toward the inner side Dri in the radial direction Dr. By forming such a concave portion 47, the weight of the disk 41 is reduced.

A surface of the disk 41 facing the first side Dau in the axial direction Da is a disk main surface (front surface) 413. The disk main surface 413 is curved and extends so as to gradually be toward the outer side Dro in the radial direction Dr, from the first side Dau toward the second side Dad in the axial direction Da. A portion of the disk main surface 413 on the first side Dau in the axial direction Da is toward the outer side Dro in the radial direction Dr. A portion of the disk main surface 413 on the second side Dad in the axial direction Da is toward the first side Dau in the axial direction Da. The disk main surface 413 has a concave curved surface shape.

A plurality of the blades 42 are provided on the disk main surface 413 at intervals in a circumferential direction of the axis O. Each blade 42 extends from the disk main surface 413 toward the first side Dau in the axial direction Da.

The cover 43 covers the plurality of blades 42 from the first side Dau in the axial direction Da. The cover 43 is disposed to face the disk 41 so that the blade 42 is sandwiched between the cover and the disk 41. That is, an end portion of the blade 42 opposite to an end portion connected to the disk main surface 413 is fixed to the cover 43. The cover 43 is formed so as to gradually expand in diameter toward the outer side Dro in the radial direction Dr, from the first side Dau toward the second side Dad in the axial direction Da. In the cover 43, a cover inner surface 430 facing the disk 41 is curved and extends so as to gradually be toward the outer side Dro in the radial direction Dr, from the first side Dau toward the second side Dad in the axial direction Da. The blade 42 is connected to the cover inner surface 430. The cover inner surface 430 has a convex curved surface shape.

The cover 43 has a thin portion 48, a thick portion 49, and a transition portion 60. The thin portion 48 is a region that includes a first end portion 431 positioned on a most first side Dau in the axial direction Da in the cover 43. The thin portion 48 is a region having a smallest thickness in the cover 43. Here, the thickness is a thickness in a direction orthogonal to the cover inner surface 430. The thin portion 48 has a constant thickness in the axial direction Da.

The thick portion 49 is a region that includes the second end portion 432 positioned on a most second side Dad in the axial direction Da in the cover 43. The thick portion 49 is a region having a largest thickness in the cover 43. That is, a thickness T2 of the thick portion 49 is larger than a thickness T1 of the thin portion 48. A region A in which the thick portion 49 is formed is formed at a position distant from the first end portion 431 in the axial direction Da. The region A is formed at a position overlapping with a position of the bottom 47*b* of the concave portion 47 in the axial direction Da. In the thick portion 49 of the present embodiment, the thickness increases from the first side Dau toward the second side Dad in the axial direction Da.

Further, in the present embodiment, the thick portion 49 having a large thickness is, for example, a region in which a thickness is larger than the average value of a thickness of the first end portion 431 and a thickness of the second end portion 432 in the cover 43.

The transition portion 60 is a region that connects the first end portion 431 and the thick portion 49 with each other. That is, the transition portion 60 is a region that connects the thin portion 48 and the thick portion 49 with each other. In the transition portion 60, the thickness increases from the first side Dau toward the second side Dad in the axial direction Da. The transition portion 60 smoothly connects an outer peripheral surface of the thin portion 48 to an outer peripheral surface of the thick portion 49. Therefore, a thickness of the cover 43 gradually increases from the thin portion 48 toward the thick portion 49. That is, the cover 43 is formed to have the smallest thickness at the first end portion 431 and the largest thickness at the second end portion 432.

In the impeller 40, an impeller flow path 45 is formed between the cover inner surface 430, the disk main surface 413, and the blade 42. The impeller flow path 45 extends while being curved so as to be toward the outer side Dro in the radial direction Dr, from the first side Dau toward the second side Dad in the axial direction Da. The impeller flow path 45 has an inlet 451 and an outlet 452. The inlet 451 is formed at an end portion of the impeller 40 on the first side Dau in the axial direction Da and on the inner side Dri in the radial direction Dr. The inlet 451 is open toward the first side Dau in the axial direction Da. The outlet 452 is formed at an end portion of the impeller 40 on the second side Dad in the axial direction Da and on the outer side Dro in the radial direction Dr. The outlet 452 is open toward the outer side Dro in the radial direction Dr.

As shown in FIG. 1, in such a centrifugal compressor 10, the working fluid G is introduced from the suction port 25 into the casing-side flow path 50. The working fluid G is compressed by passing through the impeller flow path 45 of the impeller 40 that rotates around the axis O together with the rotating shaft 30. Specifically, as shown in FIG. 2, in the rotating impeller 40, the working fluid G is introduced into the impeller flow path 45 from the inlet 451. The working fluid G introduced into the impeller flow path 45 flows from the inner side Dri to the outer side Dro in the radial direction Dr and is pressurized in the impeller flow path 45 from the first side Dau toward the second side Dad in the axial direction Da. The working fluid G pressurized in the impeller flow path 45 is discharged from the outlet 452 to the diffuser portion 51 (see FIG. 1) on the outer side Dro in the radial direction Dr.

As shown in FIG. 1, the working fluid G discharged to the diffuser portion 51 flows to the outer side Dro in the radial direction Dr, and the flow direction is reversed at the return bend portion 52. After that, the working fluid G is sent to another impeller 40 disposed at a subsequent stage through the return flow path 53. In this way, the working fluid G is compressed in multiple stages by passing through the impeller 40 and the casing-side flow path 50 provided in multiple stages from the first end portion 20*a* to the second end portion 20*b* of the casing 20, and is discharged from the discharge port 26.

According to the impeller 40 and the centrifugal compressor 10 as described above, in the cover 43, the thickness T2 of the thick portion 49 formed on the second side Dad in the axial direction Da is larger than the thickness T1 of the thin portion 48 formed on the first side Dau in the axial direction Da. That is, in the cover 43, only the thick portion 49 is thicker than other regions. As a result, the weight of the cover 43 is reduced.

Further, the second end portion 432 of the cover 43 is positioned closer to the outer side Dro in the radial direction Dr than the first end portion 431. That is, in the cover 43, a centrifugal force when the impeller 40 rotates around the axis O acts more as being further distant from the first end portion 431 in the axial direction Da. Further, a pressure of the working fluid G flowing through the impeller flow path 45 increases from the inner side Dri toward the outer side Dro in the radial direction Dr. That is, in the cover 43, a more pressure by the working fluid G acts as being further distant from the first end portion 431 in the axial direction Da. In particular, in the impeller 40 corresponding to a large flow rate through which a large amount of the working fluid flows, the impeller flow path 45 is largely inclined with respect to the axis O near the outlet 452 as in the present embodiment. As a result, the pressure acted by the working fluid G near the outlet 452 increases. On the other hand, in the cover 43, by making the region including the second side Dad in the axial direction Da the thickest thick portion 49, a sufficient strength of the impeller 40 is secured against the centrifugal force and the pressure of the working fluid G.

Therefore, even if a large centrifugal force or a large pressure of the working fluid G acts on the second side Dad in the axial direction Da of the cover 43, the thick portion 49 can secure a sufficient strength. In addition, since the thin portion 48 and the transition portion 60 are formed without forming the entire region of the cover 43 with the thickness T2 of the thick portion 49, further reduction in weight can be achieved while maintaining the necessary strength of the impeller 40.

In addition, the thickness of the thick portion 49 increases toward the second side Dad in the axial direction Da, and is thickest at the second end portion 432. Thus, when the impeller 40 rotates, the thickness T2 of the thick portion 49 can be partially increased in response to an influence of the working fluid G of which a pressure gradually increases toward the vicinity of the outlet 452. Therefore, the necessary strength of the impeller 40 can be appropriately maintained without increasing the weight excessively.

In addition, in the cover 43, the outer peripheral surface of the thin portion 48 and the outer peripheral surface of the thick portion 49 are smoothly connected to each other by the transition portion 60. That is, the thickness of the cover 43 is gradually increased toward the second side Dad in the axial direction Da. Therefore, the cover 43 is thickened over a wide region in the axial direction Da so as to correspond to an increase in pressure of the working fluid G flowing through the impeller flow path 45. Accordingly, the thickness of the cover 43 can be partially increased in response to the influence of the working fluid G flowing through the impeller flow path 45. As a result, a shape of the cover 43 can be made an appropriate shape according to the pressure of the working fluid G. In addition, since the thickness gradually increases, a locally high stress is hardly generated in the cover 43. Therefore, the necessary strength of the impeller 40 can be more appropriately maintained.

In addition, in the axial direction Da, a thick portion 49 is formed in the region A overlapping with the position of the bottom 47*b* of the concave portion 47 formed in the disk 41. In the portion where the concave portion 47 is formed, a rigidity of the disk 41 decreases. As a result, when the impeller 40 rotates, the disk 41 is deformed to collapse toward the first side Dau in the axial direction Da with the bottom 47*b* as a reference point. Accordingly, a high stress is generated in the vicinity of the inlet 451 near the bottom 47*b* even in the connection portion between the disk 41 and the blade 42. On the other hand, the thick portion 49 is formed in the axial direction Da so as to correspond to the position where the bottom 47*b* of the concave portion 47 is formed. As a result, bending composition of the cover 43 increases, and the deformation of the disk 41 can be suppressed via the blade 42. That is, the disk 41 can be reinforced by the cover 43 via the blade 42. Accordingly, the stress generated at the connection portion between the disk 41 and the blade 42 can be reduced.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, the shape of the impeller 40 is not limited to the shape of the present embodiment. For example, in the impeller 40, the concave portion 47 may not be formed in the disk 41.

In addition, the thick portion 49 is not limited to the structure in which the thickness increases from the first side Dau toward the second side Dad in the axial direction Da as in the present embodiment. The thick portion 49 may be formed in the cover 43 so that the thickness is locally increased. In addition, the thick portion 49 is not limited to being connected to the thin portion 48 via the transition portion 60. The thick portion 49 may be formed distant from the thin portion 48 as long as it is formed at a position distant from the first end portion 431.

Furthermore, although the centrifugal compressor 10 is illustrated as an example of the rotating machine, the present invention is not limited to this, and the same configuration can be applied to other rotating machines such as a pump as long as an impeller is provided.

EXPLANATION OF REFERENCES

10: centrifugal compressor (rotating machine)
20: casing
20*a*: first end portion (one end portion)
20*b*: second end portion (other end portion)
24: internal space
25: suction port
26: discharge port
28A, 28B: journal bearing
29: thrust bearing
30: rotating shaft
40: impeller
41: disk
42: blade
43: cover
45: impeller flow path
47: concave portion
47*b*: bottom
48: thin portion
49: thick portion
60: transition portion
50: casing-side flow path
51: diffuser portion
52: return bend portion
53: return flow path
411: through-hole
412: back surface
413: disk main surface (front surface)
430: cover inner surface
431: first end portion
432: second end portion
451: inlet
452: outlet
A: region
Da: axial direction
Dau: first side
Dad: second side
Dr: radial direction
Dri: inner side
Dro: outer side
G: working fluid (process gas)
O: axis
T1, T2: thickness

What is claimed is:

1. An impeller comprising:
a disk having a disk shape centered on an axis;
a plurality of blades provided on a front surface of the disk facing a first side in an axial direction at intervals in a circumferential direction around the axis; and
a cover that covers the plurality of blades from the first side and gradually expands in diameter from the first side toward a second side in the axial direction,
wherein the cover has a thick portion at a position distant from a first end portion positioned closest to the first side, the thick portion having a thickness greater than a thickness of the first end portion.

2. The impeller according to claim 1,
wherein the thickness of the thick portion increases from the first side toward the second side.

3. The impeller according to claim 1,
wherein the cover has a transition portion that connects the first end portion and the thick portion with each other and increases in thickness from the first side toward the second side.

4. The impeller according to claim 1,
wherein in the disk, a concave portion is formed on a back surface facing the second side in the axial direction, the concave portion being recessed toward the first side in the axial direction, and
wherein in the axial direction, the thick portion is formed in a region overlapping with a position of a bottom of the concave portion in the axial direction.

5. A rotating machine comprising:

a rotating shaft that is configured to rotate around an axis; and the impeller according to claim 1 fixed to the rotating shaft.

6. The impeller according to claim 2, wherein the cover has a transition portion that connects the first end portion and the thick portion with each other and increases in thickness from the first side toward the second side.

7. The impeller according to claim 2, wherein in the disk, a concave portion is formed on a back surface facing the second side in the axial direction, the concave portion being recessed toward the first side in the axial direction, and wherein in the axial direction, the thick portion is formed in a region overlapping with a position of a bottom of the concave portion in the axial direction.

8. A rotating machine comprising:

a rotating shaft that is configured to rotate around an axis; and the impeller according to claim 2 fixed to the rotating shaft.

9. A rotating machine comprising:

a rotating shaft that is configured to rotate around an axis; and the impeller according to claim 3 fixed to the rotating shaft.

10. A rotating machine comprising:

a rotating shaft that is configured to rotate around an axis; and the impeller according to claim 4 fixed to the rotating shaft.

11. A rotating machine comprising:

a rotating shaft that is configured to rotate around an axis; and the impeller according to claim 6 fixed to the rotating shaft.

12. A rotating machine comprising:

a rotating shaft that is configured to rotate around an axis; and the impeller according to claim 7 fixed to the rotating shaft.

* * * * *